US006010362A

United States Patent [19]

Caviness et al.

[11] Patent Number: 6,010,362

[45] Date of Patent: Jan. 4, 2000

[54] TRANSFORMER BOARD MOUNT

[75] Inventors: Mark Swain Caviness, Harrisburg; Gary Douglas Porta, New Cumberland, both of Pa.

[73] Assignee: The Whitaker Corporation, Wilmington, Del.

[21] Appl. No.: 09/115,972

[22] Filed: Jul. 15, 1998

Related U.S. Application Data

[60] Provisional application No. 60/054,375, Jul. 31, 1997.

[51] Int. Cl.[7] ..... H01R 13/73

[52] U.S. Cl. ..... 439/567; 439/395; 336/192; 336/208

[58] Field of Search ..... 439/567, 571, 439/572, 395, 404, 198, 208, 192

[56] References Cited

U.S. PATENT DOCUMENTS

| | | | |
|---|---|---|---|
| 3,504,328 | 3/1970 | Olsson | 339/17 |
| 3,636,500 | 1/1972 | Sedlacek | 439/395 |
| 3,701,961 | 10/1972 | Folk | 336/192 |
| 3,988,707 | 10/1976 | Moser et al. | 439/395 |
| 4,177,397 | 12/1979 | Lill | 439/395 |
| 4,261,629 | 4/1981 | Reynolds et al. | 339/17 C |
| 4,377,321 | 3/1983 | Weisenburger | 339/220 R |
| 4,490,004 | 12/1984 | Lawrence et al. | 339/95 R |
| 4,630,879 | 12/1986 | Van Alst | 330/99 R |
| 5,073,126 | 12/1991 | Kikuchi et al. | 439/452 |
| 5,282,758 | 2/1994 | Onoue | 439/395 |
| 5,683,266 | 11/1997 | Guidi et al. | 439/395 |
| 5,726,619 | 3/1998 | Hohorst et al. | 336/192 |

*Primary Examiner*—Gary F. Paumen
*Attorney, Agent, or Firm*—Robert Kapalka

[57] ABSTRACT

A board mount for an electrical transformer is provided by a unitary body having a wire termination section and a boardlock. The body is mountable to a transformer bobbin with an end of a transformer wire being terminated in the wire termination section and with the boardlock extending externally of the bobbin. The transformer can be electrically and mechanically mated with a circuit board by inserting the boardlock into a hole in the circuit board.

7 Claims, 2 Drawing Sheets

TRANSFORMER BOARD MOUNT

This application claims priority of provisional application Ser. No. 60/054,375 filed Jul. 31, 1997.

FIELD OF THE INVENTION

The invention relates to a device for securing and electrically connecting a transformer to a circuit board.

BACKGROUND OF THE INVENTION

A flyback transformer for a television is typically mounted on a circuit board and electrically connected to circuit paths on the board. A known method of mounting a flyback transformer on a circuit board utilizes multiple wire pins that are installed in a base of a transformer bobbin to serve as legs for the transformer. Multiple magnet wires are wound onto the bobbin to create conductive wire windings, and ends of the wires are wrapped around the pins. The wire ends are joined to their respective pins by solder in a hand soldering operation, and a hot melt glue may also be applied over the solder joints to provide an additional measure of security. When transformer assembly is complete, the transformer is mounted on the circuit board with the transformer legs installed in holes in the circuit board. The legs are then soldered to the circuit board in a hand solder or wave solder process.

This process has a number of disadvantages. First, the process is labor intensive and therefore expensive. Second, the solder joints may crack due to shock or vibration, thereby interfering with signal integrity. Third, when the transformer is mounted to a low cost paper based circuit board, tear out of the pins from the board may occur. This problem can be avoided by manually crimping eyelets into the circuit board holes to reinforce them, but this increases the cost of the board. There is a need for a transformer to circuit board mounting device which overcomes these problems.

SUMMARY OF THE INVENTION

The invention provides a device for mounting an electrical transformer including a bobbin and windings of conductive wires onto a circuit board. The device comprises the bobbin having a plurality of stalls, and board mounts mounted in respective ones of the stalls. Each of the board mounts comprises a unitary body having a wire termination section and a boardlock. The board mounts are mounted with ends of the conductive wires being terminated in the wire termination sections and the boardlocks extending externally of the bobbin, wherein the electrical transformer can be electrically and mechanically mated with a circuit board by inserting the boardlocks into respective holes in the circuit board.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
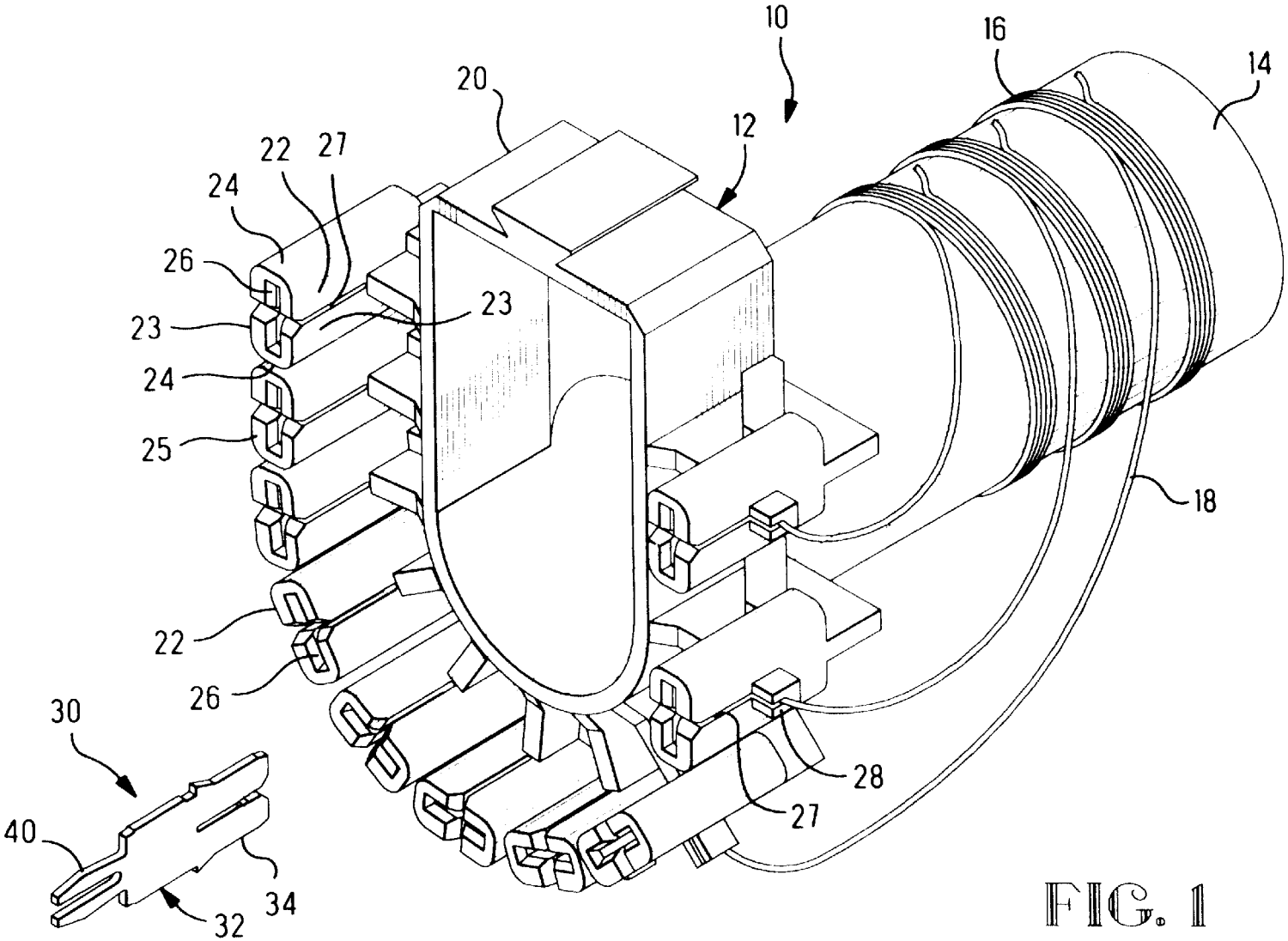
FIG. 1 is an isometric view of a transformer having a circuit board mounting device according to the invention.

There is shown in FIG. 1 an electrical transformer 10 which includes a bobbin 12 having a cylindrical core 14 and a number of windings 16 of conductive wires 18 which are wrapped around the cylindrical core. Each of the windings 16 is made from multiple turns of a conductive wire 18 which typically has a thin insulative coating or varnish, such wire being commonly termed "magnet wire". Ends of each conductive wire 18 are terminated to respective electrical terminals each of which comprises a board mount 30 according to the invention.

The bobbin 12 has a base portion 20 with a plurality of stalls 22 arranged in a U-shaped configuration around the base portion. Each of the stalls 22 has outer walls including a pair of main walls 23 which are joined together by connecting walls 24. Each of the stalls has a board-mounting face 25 and an opening which extends inwardly from the board-mounting face to define a cavity 26 which is surrounded by the walls 23, 24 and dimensioned to receive one of the board mounts 30. Each of the stalls also has a wire receiving slot 27 which extends into the main walls 23 from the board-mounting face 25. The wire receiving slot 27 intersects the cavity 26 and extends into a wire stand 28 on one of the main walls 23 to provide an elongated supporting surface for an end of the wire 18.

Figure 2:
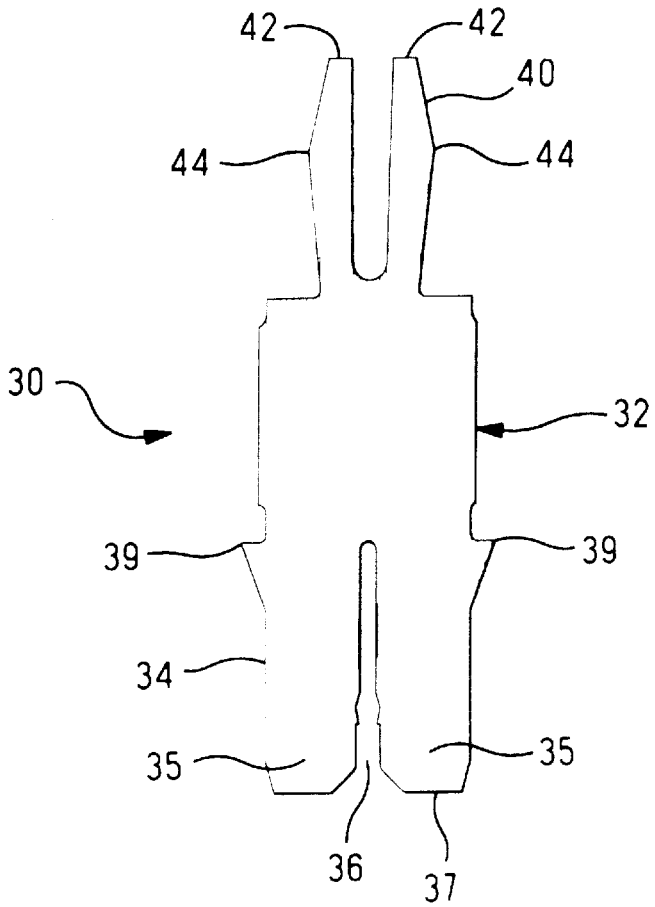
FIG. 2 is a plan view of an individual board mount according to the invention.
Figure 3:
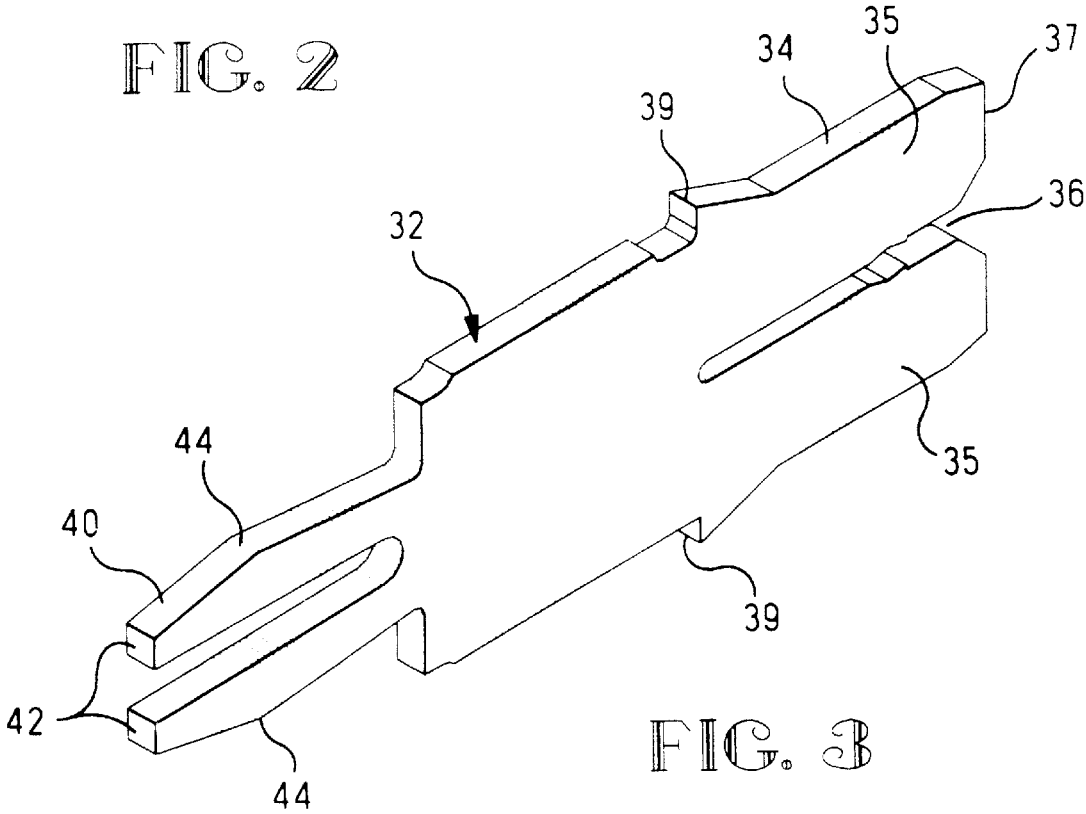
FIG. 3 is an isometric view of the board mount.

With reference to FIGS. 2 and 3, the board mount 30 comprises a unitary body 32 which is edge stamped from sheet material. The body 32 has a wire termination section 34 comprising opposed beams 35 which define a wire termination slot 36 extending inwardly from a leading edge 37 of the body. The slot 36 has a width between the opposed beams which is dimensioned marginally smaller than the diameter of the wire 18 which is to be received in the slot 27, whereby when the wire is installed in the slot the opposed beams displace any insulative coating or varnish on the wire and make electrical contact with the wire.

The body 32 further includes a boardlock 40 which is configured to cooperate with a hole in a circuit board (not shown) to retain the body to the circuit board. In the illustrated embodiment the boardlock 40 comprises a pair of legs 42 which are resiliently deflectable in a plane of the body when the boardlock is inserted into a circuit board through-hole. The legs 42 have outer edge surfaces which diverge to form peaks 44, and a dimension between the peaks is selected to be larger than the diameter of the through-hole so that the legs will be deflected together when they are inserted into the through-hole and the legs will resiliently spring back when the peaks pass through the circuit board, thereby capturing the circuit board. Although a preferred configuration of the boardlock has been shown and described, it should be understood that a multitude of other boardlock configurations may be utilized to retain the body to the circuit board, and all such configurations are considered to be within the scope of the invention.

Each of the wires 18 is terminated by placing ends of the wire in respective ones of the wire receiving slots 27 of the stalls 22. Board mounts 30 are installed leading edge 37 first into each of the cavities 26 so that the ends of the wire 18 are captured and terminated in the wire termination slot 36 of each board mount. Each of the board mounts 30 has barbs 39 which secure the board mount in its cavity 26. After all of the wire ends are terminated a completed transformer assembly is provided and ready for mounting on a circuit board. Each of the boardlocks 40 extends externally of the bobbin 12 for reception in a corresponding circuit board hole, and the transformer is mounted on a circuit board by installing the boardlocks 40 into their respective circuit board holes. The boardlocks 40 are electrically connected to circuit paths on the circuit board by direct engagement with circuit traces on the circuit board. The electrical connections may be enhanced by having the boardlocks engage in circuit board holes which have been metalized such as by plating or with eyelets. The boardlocks may also be soldered to the circuit traces to provide secure and reliable connections.

The invention provides a simple and economical board mount for a transformer or other electro-mechanical device. The board mount is installed on the transformer with a simple insertion, and the board mount terminates a wire of the transformer during the insertion. The board mount permits the transformer to be electrically and mechanically mated to a circuit board by simply plugging the transformer into the board.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A board mount for an electrical transformer which includes a bobbin and a winding of conductive wire, the board mount comprising:

a unitary body having a wire termination section and a boardlock, the body being mountable to the bobbin with an end of the conductive wire being terminated in the wire termination section and with the boardlock extending externally of the bobbin, wherein the body is a planar member which is edge stamped from sheet material, the wire termination section comprises opposed beams defining a wire termination slot and the boardlock comprises resilient legs, wherein the electrical transformer can be electrically and mechanically mated with a circuit board by inserting the boardlock into a hole in the circuit board.

2. A device for mounting an electrical transformer including a bobbin and windings of conductive wires on a circuit board, the device comprising:

the bobbin having a plurality of stalls; and board mounts mounted in respective said stalls, each said board mount comprising a unitary body having a wire termination section and a boardlock, ends of respective said conductive wires being terminated in the wire termination sections and the boardlocks extending externally of the bobbin, wherein the electrical transformer can be electrically and mechanically mated with a circuit board by inserting the boardlocks into respective holes in the circuit board.

3. The device according to claim 2, wherein each of the stalls has outer walls and an internal cavity, and the board mounts are mounted with the wire termination sections disposed in the cavities.

4. The device according to claim 3, wherein each of the stalls has a wire receiving slot which intersects its respective said cavity.

5. The device according to claim 2, wherein the plurality of stalls are arranged in a U-shaped configuration on the bobbin.

6. The device according to claim 2, wherein each said body is a planar member.

7. A board mount for an electro-mechanical device which includes at least one conductive wire, the board mount comprising:

a unitary body having a wire termination section and a boardlock, the body being mountable to the electromechanical device with an end of the conductive wire being terminated in the wire termination section and with the boardlock extending externally of the electromechanical device, wherein the body is a planar member which is edge stamped from sheet material, the wire termination section comprises opposed beams defining a wire termination slot and the boardlock comprises resilient legs, wherein the electro-mechanical device can be electrically and mechanically mated with a circuit board by inserting the boardlock into a hole in the circuit board.

* * * * *